US005798777A

United States Patent [19]

Yoshimura et al.

[11] Patent Number: 5,798,777

[45] Date of Patent: Aug. 25, 1998

[54] INK JET PRINTER HAVING A CAPPING MECHANISM

[75] Inventors: Kotaro Yoshimura; Shigemi Togashi; Osamu Watanabe, all of Tokyo, Japan

[73] Assignee: Oki Data Corporation, Tokyo, Japan

[21] Appl. No.: 718,115

[22] Filed: Sep. 18, 1996

[30] Foreign Application Priority Data

Sep. 19, 1995 [JP] Japan ..... 7-239617

[51] Int. Cl.[6] ..... B41J 2/165

[52] U.S. Cl. ..... 347/44; 347/29

[58] Field of Search ..... 342/44, 149, 87, 342/49, 29; 347/87

[56] References Cited

U.S. PATENT DOCUMENTS 5,289,213 2/1994 Murai et al. ..... 347/29

FOREIGN PATENT DOCUMENTS 5-8399 1/1993 Japan ..... B41J 2/165

*Primary Examiner*—Benjamin R. Fuller
*Assistant Examiner*—Thien Tran
*Attorney, Agent, or Firm*—Rabin & Champagne, P.C.

[57] ABSTRACT

An ink cassette is used in an ink jet printer and has nozzles through which ink is ejected. The ink cassette has a pair of nozzle levers with a cap formed between their free ends. The cap closes the nozzles when the nozzle levers pivot to a closing position and leaves the nozzles exposed when the levers pivot to an opening position. A carriage unit receives the ink cassette therein and moves between a print area and a non-print area. The carriage unit has supports on which the ink cassette pivots between a first position and a second position. When the ink cassette pivots to the first position, the ink cassette is engaged with a lock lever which holds the ink cassette in position, and the nozzle lever is engaged with lugs formed on the carriage unit which cause the nozzle levers to pivot to the opening position when the ink cassette is moved to the first position. The carriage unit may have a drive lever pivotally supported on the carriage unit and the aforementioned lug may be formed on a free end of the drive lever. The drive lever pivots between a third position where the lug engages the nozzle lever causing the nozzle lever to pivot to the opening position, and a fourth position where the post disengages from the nozzle causing the nozzle lever to pivot to the closing position.

4 Claims, 12 Drawing Sheets

INK JET PRINTER HAVING A CAPPING MECHANISM

BACKGROUND OF THE INVENTION

The present invention relates to an ink jet printer.

Conventional ink cassettes for use in ink jet printers are of a construction where an ink tank is integral with a print head supplied with ink from the ink tank.

FIG. 12 illustrates a conventional ink cassette 501 immediately before being inserted into the carriage unit 502. FIG. 13 is a perspective view of the ink cassette 501 showing a print head 505 and nozzles 506. The ink cassette 501 has the print head 505 formed at the end portion of the ink cassette 501. The print head 505 has a plurality of the exposed nozzles 506 through which ink drops are ejected.

With an ink jet printer using the aforementioned conventional ink cassette, the ink in the vicinity of the nozzles 506 is apt to dry, leaving the exposed nozzles 506 clogged. The clogged nozzles result in missing dots in the printed image. This leads to poor print quality. In order to prevent the ink from drying in the vicinity of the nozzles 506, a capping mechanism is conventionally used. The capping mechanism is adapted to close the nozzles 506 of the print head 505 upon mounting the ink cassette 501 into the carriage unit 502. The capping mechanism opens the nozzles only when printing operation is being performed, thereby preventing the ink from drying.

FIG. 14 illustrates the conventional ink cassette 501 as being mounted to the carriage unit, not shown, and ready for printing operation. Referring to FIG. 14, the ink cassette 501 is moved in a direction perpendicular to the page of FIG. 14 during a printing operation. Guides 503 and 504 are disposed over a frame 502 of the ink jet printer, defining a small gap or paper path between guides 503 and 504 and the frame 502. The ink cassette 501 is disposed between the guides 503 and 504, and print paper 507 is transported under the ink cassette through the gap.

The print paper 507 is fed in a direction shown by arrow A and travels through the gap between the guide 503 and the frame 502. Printing is effected when the print paper 507 passes under the print head 505. Then, the print paper 507 is further transported in the direction shown by arrow B between the guide 504 and the frame 502 to an exit stacker, not shown.

However, when simultaneously using a plurality of ink cassettes, for example, color ink cassettes in combination with a black ink cassette, the capping mechanism of the aforementioned conventional ink jet printer fails to ensure that all the ink cassettes are prevented from drying. The ink in the nozzles 506 dries while the ink cassette 501 is left outside of the carriage unit.

Therefore, the ink cassette 501 is usually accommodated in an exclusive ink cassette holder, not shown, so as to prevent the ink from drying. However, accommodating the ink cassette in an exclusive holder is not only cumbersome but also insufficient.

SUMMARY OF THE INVENTION

The present invention was made in view of the aforementioned drawbacks. An object of the invention is thus to provide an ink jet printer where a simple and effective device prevents ink from drying.

An ink cassette is used in an ink jet printer and has nozzles through which ink is ejected. The ink cassette has a pair of nozzle levers with a cap formed between their free ends. The cap closes the nozzles when the nozzle levers pivot to a closing position and leaves the nozzles exposed when the nozzle levers pivot to an opening position. A carriage unit receives the ink cassette therein and moves between a print area and a non-print area. The carriage unit has projections on which the ink cassette pivots between a first position and a second position. When the ink cassette pivots to the first position, the ink cassette is engaged with a lock lever which holds the ink cassette in position, and the nozzle lever is engaged with posts formed on the carriage unit which cause the nozzle levers to pivot to the opening position. The carriage may have a drive lever which engages the nozzle lever to cause the nozzle lever to pivot between the closing position and opening position after the ink cassette is firmly held by the lock lever. The lug may be formed on a free end of a drive lever pivotally supported on the carriage unit, which moves to a third position causing its post to engage the nozzle lever to cause the nozzle lever to pivot to the opening position and to a fourth position causing its post to disengage from the nozzle lever to allow the nozzle lever to pivot to the closing position. When the carriage unit moves to the non-print area, the drive lever is engaged with a part of the printer which causes the drive lever to pivot to the fourth position.

DETAILED DESCRIPTION OF THE INVENTION

First Embodiment

Figure 1:
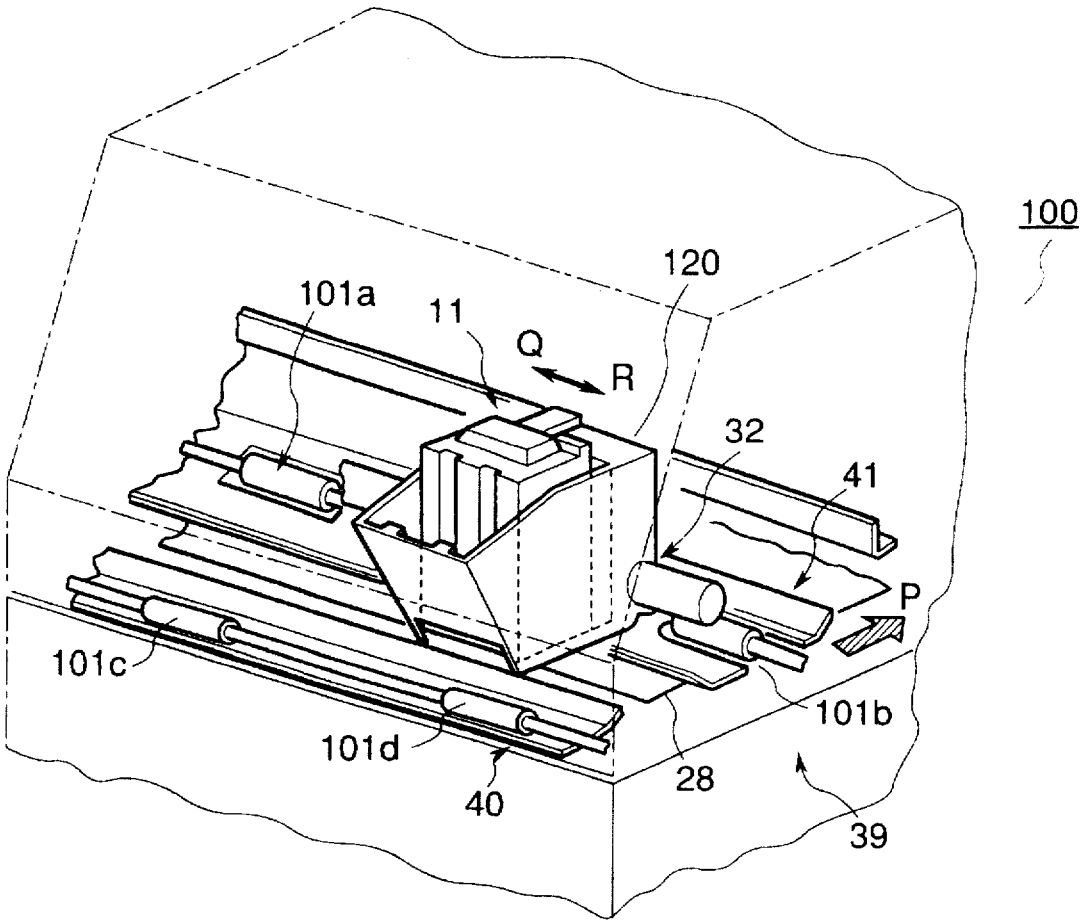
FIG. 1 a perspective view showing an ink cassette of the invention being installed in an ink jet printer.

A first embodiment of the invention will be described in detail with reference to the drawings. FIG. 1 is a perspective view showing an ink cassette 11 as being installed in an ink jet printer 100.

Referring to FIG. 1, a main frame 39 supports guides 40 and 41 and feed rollers 101*a*–101*b* and 101*c*–101*d* by which the print paper 28 is transported. A carriage unit 120 carries an ink cassette 11 therein. The feed rollers 101*a*–101*b* and 101*c*–101*d* are rotated by a drive source, not shown, to transport the print paper 28 in a direction shown by arrow P perpendicular to the direction in which the carriage unit 120 is moved. The main frame 39 also supports a shaft 32 on which carriage unit 120 moves back and forth in directions shown by arrows Q and R during a printing operation. The print head, not shown, provided at the bottom of the ink cassette 11, is controllably driven by a controller in accordance with signals from paper position and carriage position detectors, not shown, so that ink drops are ejected from the print head onto the print paper 28 to print information or images on the print paper 28.

Figure 2:
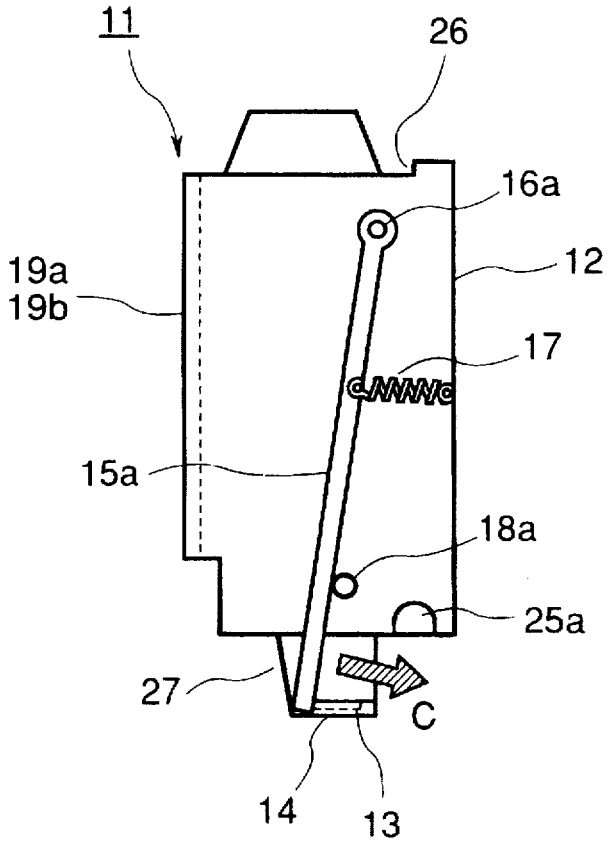
FIG. 2 is a side view of an ink cassette according to a first embodiment.
Figure 5:
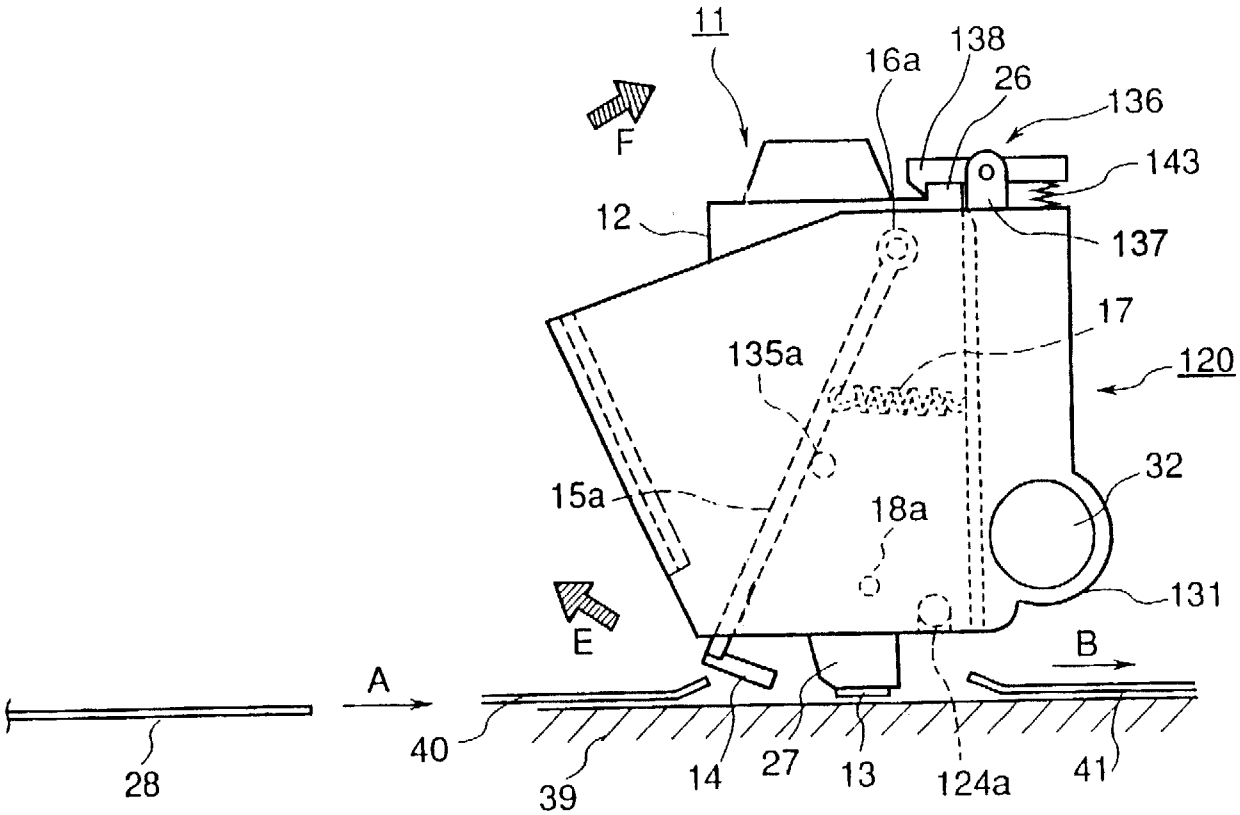
FIG. 5 is a side view showing the ink cassette as being mounted into the carriage unit.

FIG. 2 illustrates an ink cassette 11 of the invention. The ink cassette 11 includes an ink tank 12 and a print head 27. A cap 14 closes nozzles 13 in the print head 27 while also guiding the print paper 28 passing thereunder during the printing operation (FIG. 5). The cap 14 is molded integrally with levers 15*a* and 15*b* (only lever 15*a* is shown) so that the cap 14 is supported between longitudinal ends of the two levers extending in parallel with each other. The cap 14 has a rubber sheet, not shown, placed on its inner surface, with the rubber sheet opposing the nozzles 13 when closing the nozzles 13.

The levers 15*a* and 15*b* are swingably supported by projections 16*a* and 16*b* on the opposed side walls of the ink tank 12 and are adapted to swing about the projections 16 to open and close the nozzles 13. One end of a tension spring 17 is coupled to the lever 15*a* at a substantially midway point of the lever 15*a*, and the other end of the spring 17 is coupled to the side wall of the ink tank 12, so that the lever 15*a* is always urged by the spring 17 in a direction shown by arrow C. Studs 18*a* and 18*b* project outwardly of the ink cassette 11 and serve as a stopper which stops and holds the levers 15*a* (15*b*) against the biasing force of the spring 17. The cap 14 closes the nozzles 13 when the levers 15*a* and 15*b* are stopped by the studs 18*a* and 18*b*.

Figure 3:
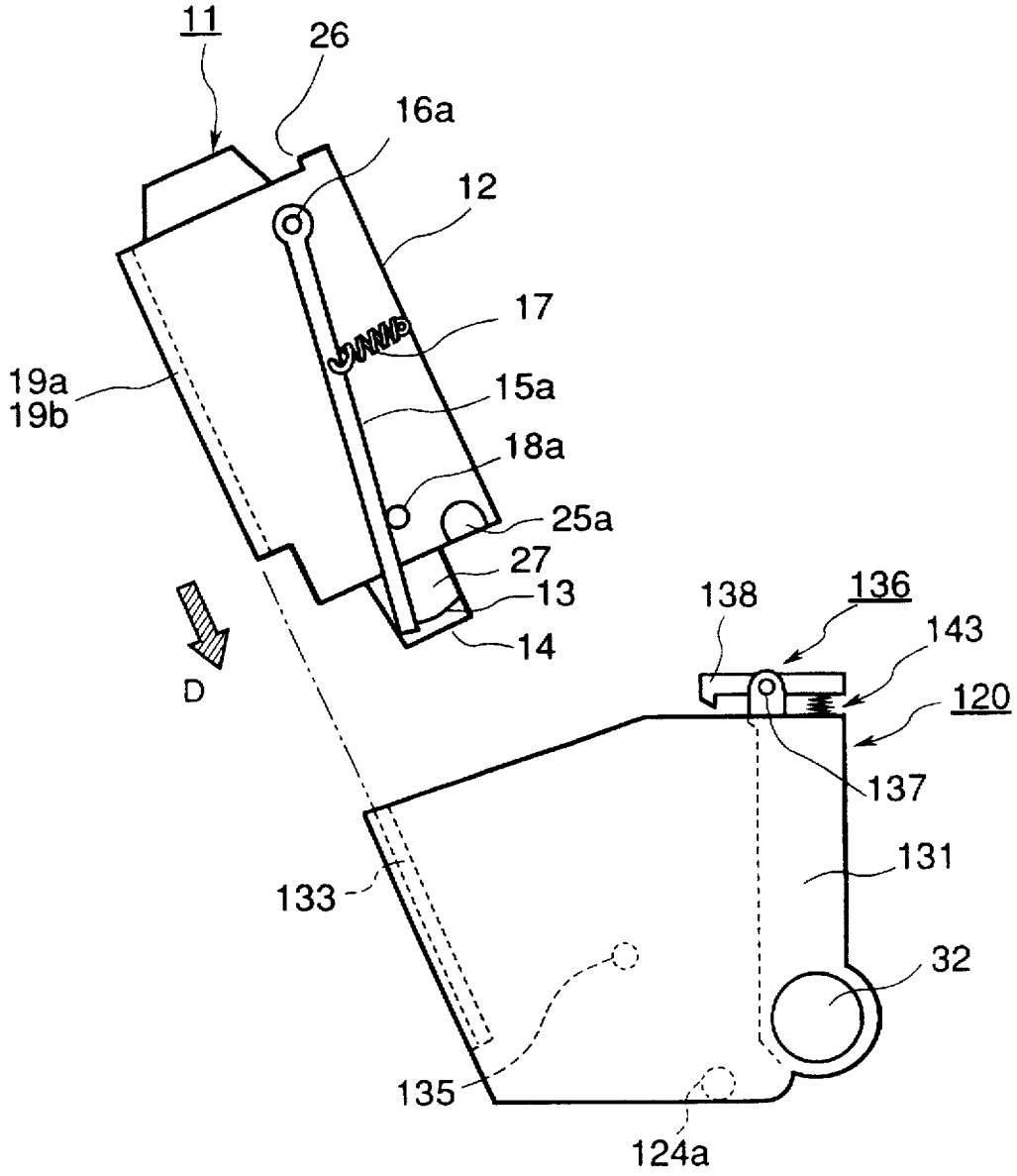
FIG. 3 is a side view showing the ink cassette according to the first embodiment immediately before the ink cassette is mounted into the carriage unit.
Figure 4:
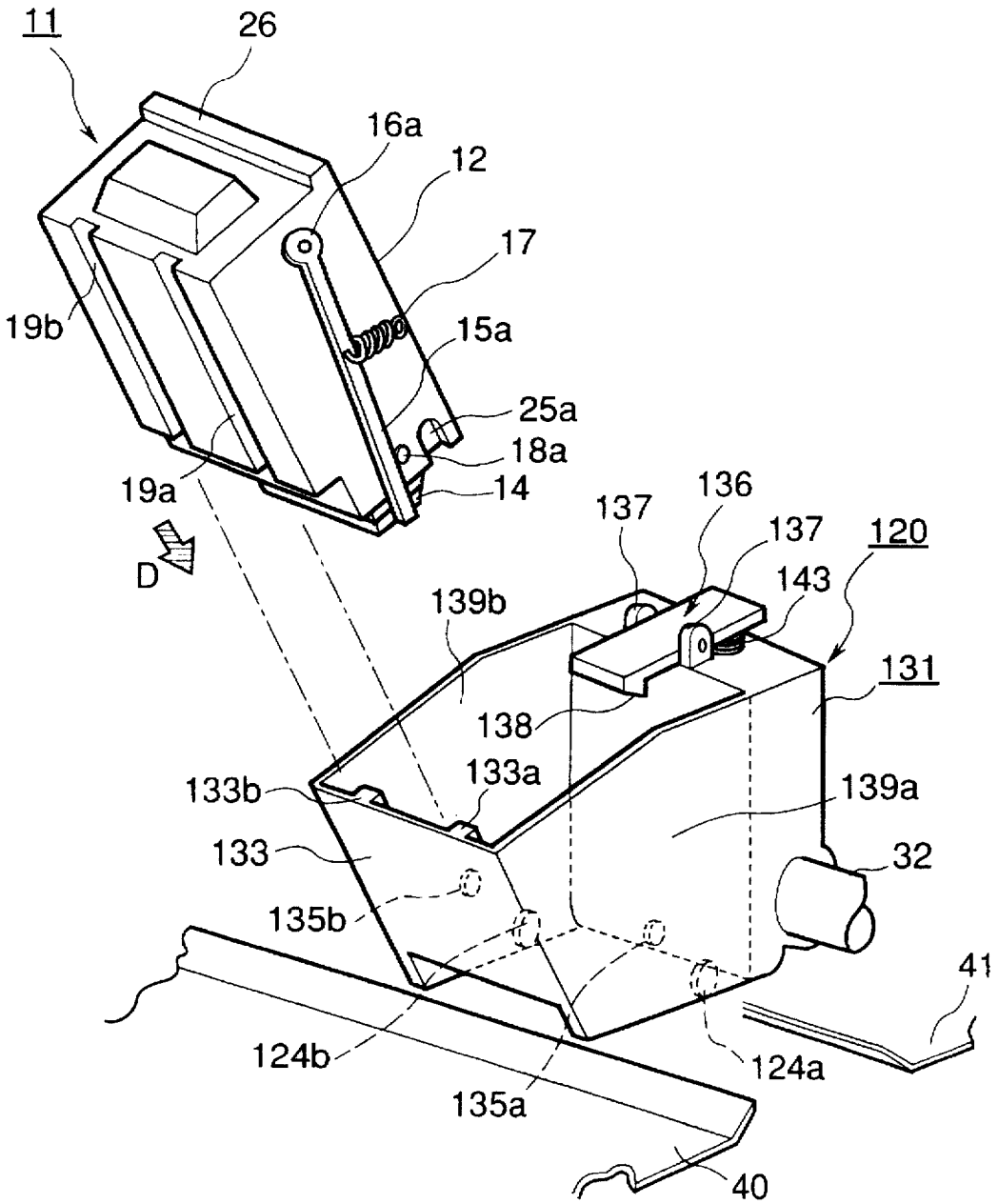
FIG. 4 is a perspective view showing the ink cassette according to the first embodiment immediately before the ink cassette is mounted into the carriage unit.

FIG. 3 is a side view showing the ink cassette 11 and the carriage unit 120. FIG. 4 is a perspective view showing the ink cassette 11 immediately before the ink cassette 11 is mounted into the carriage unit 120. The ink tank 12 is formed with grooves 19*a* and 19*b* in the front side surface (on the left side in FIG. 2) thereof. The grooves 19*a* and 19*b* serve to guide the ink cassette 11 into a carriage unit 120. The ink tank 12 is formed with recesses 25*a* and 25*b* (only 25*a* is shown) in lower end portions of the side surfaces thereof, the recesses 25*a* and 25*b* engaging later described projections 124*a* and 124*b* (FIG. 4) of the carriage unit 120. The ink tank 12 is pivotally supported by the projections 124*a* and 124*b*.

The ink tank 12 has a step 26 on its top which a later described lock lever 136 engages to firmly hold the ink tank 12 in the carriage unit 120. The carriage unit 120 is supported on the shaft 32 and moved along the shaft 32. The carriage unit 120 includes a carriage frame 131 in the shape of a generally rectangular box that opens at upper and lower ends thereof, and has an inclined front wall 133. The front wall 133 is formed with two parallel rib-like guides 133*a* and 133*b* on its inner surface that engage the grooves 19*a* and 19*b* of the ink cassette 11 when the ink cassette 11 is inserted into the carriage unit 120. The carriage unit 120 has projections 124*a* and 124*b* at lower end portions of side walls 139*a* and 139*b*, respectively, the projections 124*a* and 124*b* projecting into the carriage unit 120 and being disposed in line with each other. The projections 124*a* and 124*b* are received in the recesses 25*a* and 25*b*, respectively, when the ink cassette 11 is inserted along the grooves 19*a* and 19*b* into the carriage unit 120 in a direction shown by arrow D.

The side walls 139*a* and 139*b* each have lugs 135*a* and 135*b* which project from the side walls 139*a* and 139*b* into the carriage unit 120 and are in line with each other. The lock lever 136 is supported at its middle portion by a pair of supports 137 upright on the carriage frame 131, so that the lock lever 136 can be locked. The lock lever 136 has a locking hook 138 on one end portion thereof, and is connected to a compression spring 143 on the other end. The locking hook 138 engages the step 26 of the ink tank 12 to firmly hold the ink tank 12 in position in the carriage unit 120.

FIG. 5 is a side view showing the ink cassette 11 mounted into the carriage unit 120. Referring to FIG. 5, the print paper 28 is fed in the direction shown by arrow A between the guide 40 and the frame 39 to the area under the print head 27 which prints information on the print paper 28. The print paper 28 is further transported under the nozzles 13 of the print head 27. Then, the print paper 28 travels between the guide 41 and the frame 39 in the direction shown by arrow B to an exit stacker, not shown.

The operation of the ink jet printer 100 of the aforementioned construction will now be described with reference to FIGS. 2, 4, and 5.

As shown in FIG. 2, when the ink cassette 11 has been taken out of the carriage unit 120, the cap 14 closes the nozzles 13 to prevent the ink from drying. The lever 15*a* supporting the cap 14 is biased by the spring 17 to swing about the projection 16*a* in the direction shown by arrow C, and is stopped by the stud 18*a*.

Then, as shown in FIG. 4, the ink cassette 11 is first inserted into the carriage unit 120 so that the lower ends of the guide grooves 19*a* and 19*b* engage the guides 133*a* and 133*b*, respectively. Then, the ink cassette 11 is inserted straight into the carriage unit 120 in the direction shown by arrow D till the recesses 25*a* and 25*b* properly receive the projections 124*a* and 124*b*, respectively. Then, the ink cassette 11 is pivoted about the projections 124*a* and 124*b* in the direction shown by arrow F as shown in FIG. 5, i.e., the upper part of the ink cassette 11 is moved in the direction of the travel of the print paper, so that the ink cassette 11 snaps into locked engagement with the lock lever 136, the step 26 being firmly caught by the locking hook 138.

When the recesses 25*a* and 25*b* receive the projections 124*a* and 124*b*, respectively, there is a small gap between the lugs 135*a* and 135*b* and levers 15*a* and 15*b*. As the ink cassette 11 pivots about the projections 124*a* and 124*b* in the direction shown by arrow F as shown in FIG. 5, the lugs 135*a* and 135*b* cause the levers 15*a* and 15*b* to swing in the direction shown by arrow E so that the cap 14 leaves the nozzles 13 in the direction opposite to the direction in which the print paper travels. When the ink cassette 11 is firmly held in position by locking engagement of the step 26 with the locking hook 138, the cap 14 is sufficiently away from the nozzles 13, leaving the nozzles 13 completely exposed.

The cap 14 is in front of the nozzle 13 with respect to the traveling print paper 28, so that the outer surface of the cap 14 serves to guide the print paper 28 when the print paper 28 travels under the print head 27. Accordingly, even if the print paper 28 is somewhat curled, the print paper 28 may be smoothly guided into the area between the nozzles 13 and the frame 39, preventing paper jam, soiling of paper, and folding of paper.

When the ink cassette 11 is to be taken out of the carriage 120, the aforementioned operation is performed in reversed order. When the ink cassette 11 is fully pivoted about the projections 124*a* and 124*b* in the direction opposite to the direction shown by arrow F, the nozzles 13 are again closed by the cap 14.

The construction of the ink cassette 11 effectively prevents the ink from drying, improving print quality as well as eliminating the use of an exclusive ink cassette holder for storage.

However, if the ink cassette 11 is left mounted into the carriage unit 120 after the printing operation, the nozzles 13 are left exposed and the ink in the vicinity of the nozzles 13 will dry. Therefore, after the printing operation, the nozzles 13 are closed by a capping mechanism, not shown, provided in the ink jet printer.

Second Embodiment

The capping mechanism provided in the ink jet printer 100 is of a complex construction and requires a motor for driving the capping mechanism. Moreover, the capping mechanism is usually disposed outside of the print area in the ink jet printer 100, increasing the overall width of the ink jet printer 100.

A second embodiment is characterized in that the capping mechanism, required in the first embodiment, is eliminated and the width of the ink jet printer 100 is made narrower.

Figure 6:
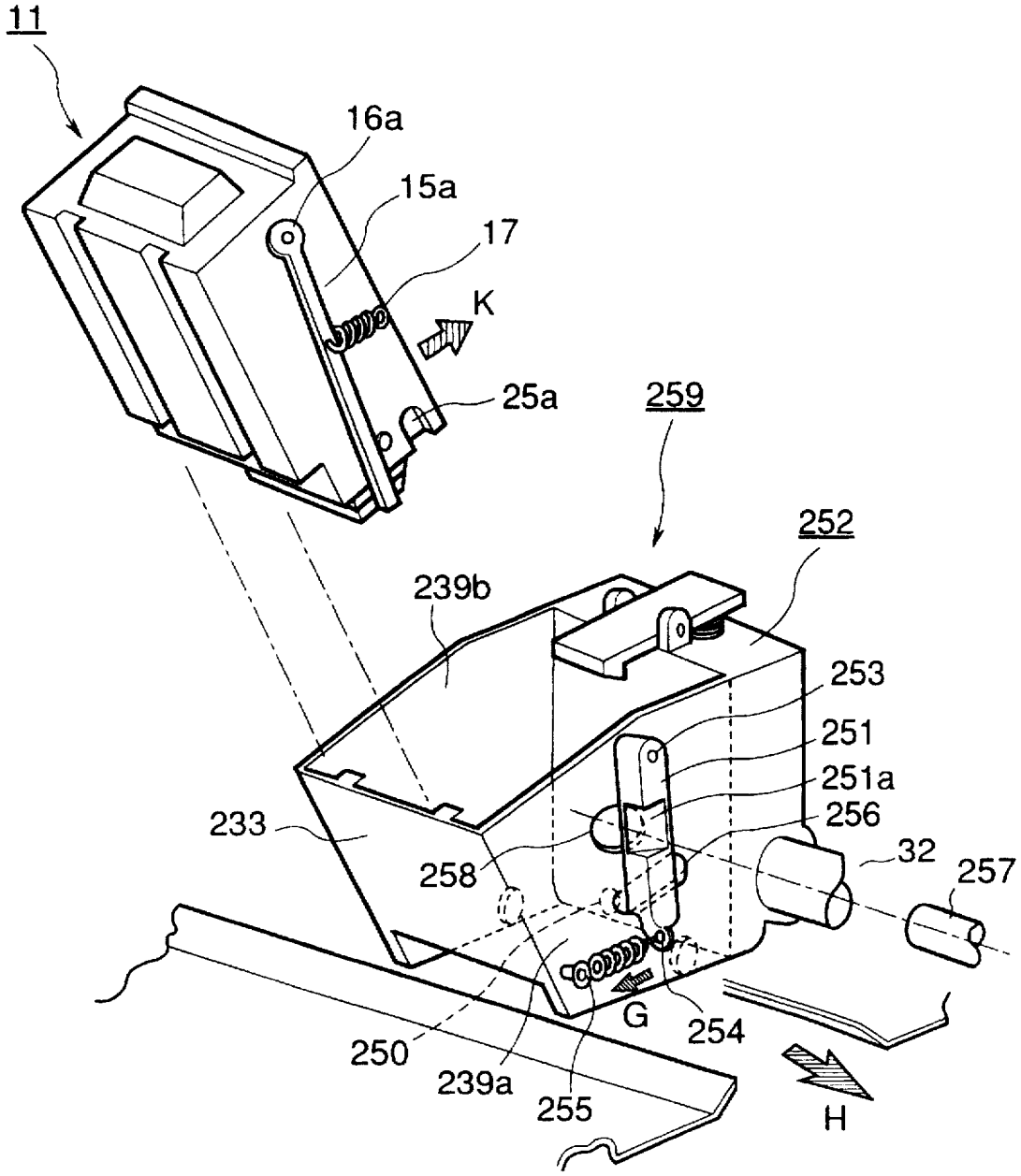
FIG. 6 is a perspective view of an ink cassette according to a second embodiment, showing the ink cassette immediately before it is mounted into a carriage unit.

FIG. 6 is a perspective view showing the ink cassette 11 and a carriage unit 259 according to the second embodiment. A drive lever 251 is pivotally supported on a stud 253 projecting from a carriage frame 252.

The drive lever 251 has a lug 250 close to its free end. The lug 250 projects into the carriage frame 252 through an arcuate hole 256 formed in a side wall 239*a* of the carriage frame 252. The drive lever 251 is formed with a hook 254 at its free end. A tension spring 255 is mounted between the hook 254 and the side wall 239*a* and biases the lever 251 in a direction shown by arrow G. Therefore, the lug 250 usually rests at an extreme end of the arcuate hole 256 as shown in FIG. 6.

The drive lever 251 is formed with a beveled surface 251*a* at its middle. A rod 257 projects from the side wall of the frame, not shown, of the ink jet printer 100.

The side wall 239*a* is formed with a round hole 258 therein into which the rod 257 extends when the carriage 259 is moved fully in the direction shown by arrow H into the non-print area.

The operation of the second embodiment will now be described with reference to FIGS. 6 and 7.

Figure 7:
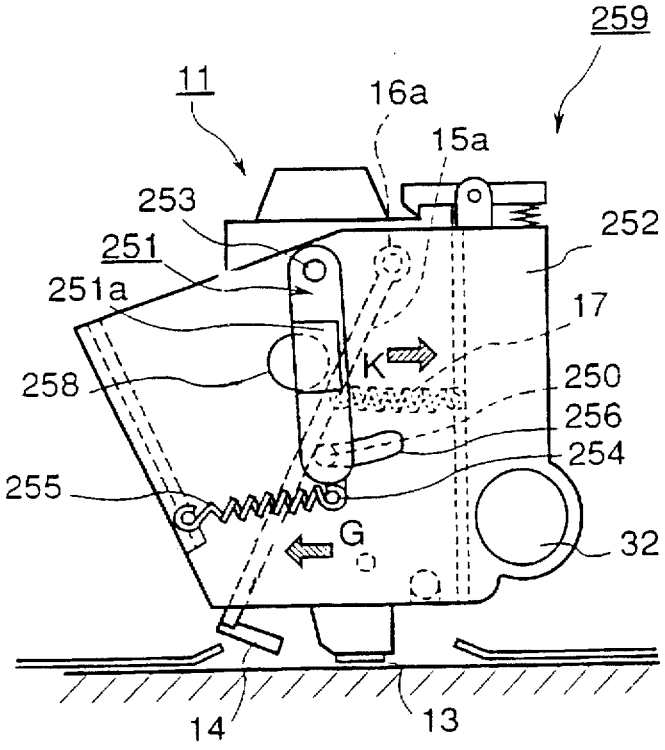
FIG. 7 shows the ink cassette as being completely mounted into the carriage unit.
Figure 8:
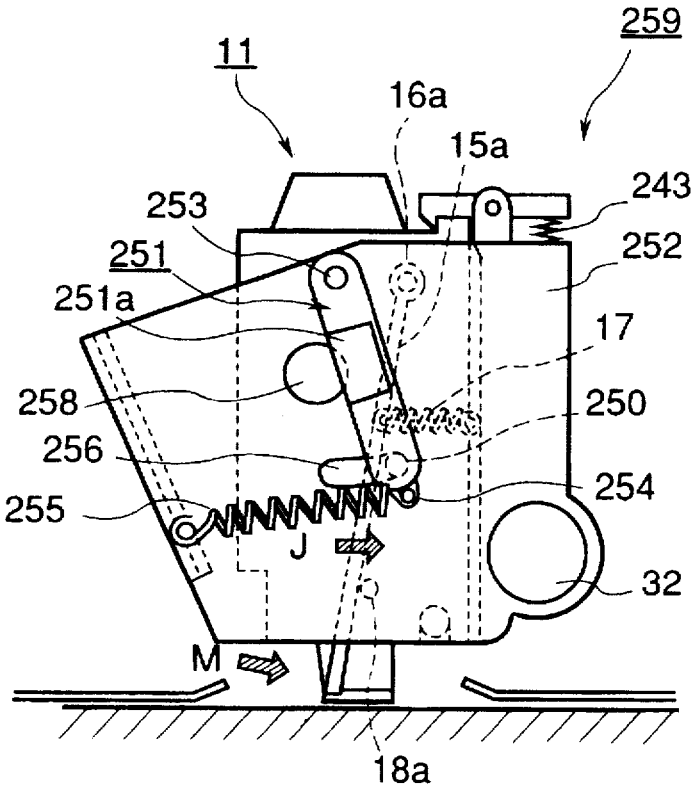
FIG. 8 illustrates the second embodiment when the carriage unit is fully moved into the non-print area.

FIG. 7 shows the ink cassette 11 completely mounted into the carriage unit 259. The tension force of the spring 255 is greater than that of the spring 17. Therefore, the lug 250 pushes the lever 15*a* causing the lever 15*a* to pivot about the projection 16*a* in the direction shown by arrow G. The pivotal motion of the lever 15*a* causes the cap 14 to completely leave the nozzles 13 exposed, the ink cassette 11 being ready for printing operation. After the printing operation has been completed, the carriage unit 259 is moved in the direction shown by arrow H as shown in FIG. 6 till the rod 257 abuts the beveled surface 251*a*. The rod 257 slides on the surface 251*a* while pushing the lever 251 out of the way. Thus, the lever 251 swings in a direction shown by arrow J as shown in FIG. 8, allowing the lever 15*a* to swing in a direction shown by arrow M till the levers 15*a* and 15*b* are stopped by the studs 18*a* and 18*b*. The rod 257 further advances into the hole 258 leaving the nozzles 13 completely closed as shown in FIG. 8. The rod 257 extends into the hole 258 only by a later described short distance LM, so that the pivotal movement of the lever 15*a* about the projection 16*a* is not obstructed by the rod 257.

Figure 9:
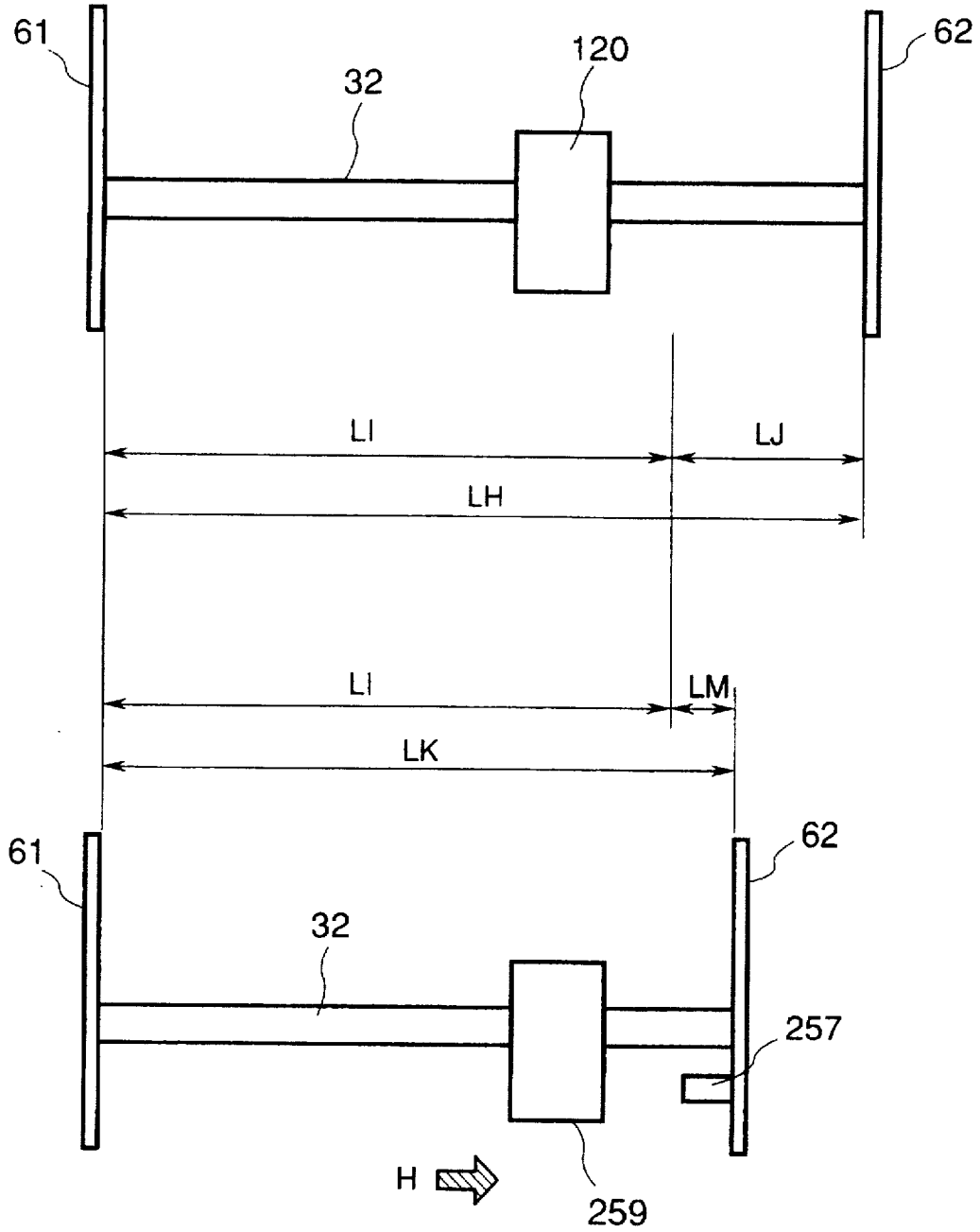
FIG. 9 is a side view of the ink jet printer of the invention, comparing the first and second embodiments.

FIG. 9 is a side view of the ink jet printer 100 of the invention and compares the first and second embodiments with respect to the print area. Referring to FIG. 9, the shaft 32 is supported by opposing side walls 61 and 62. The carriage unit 120 of the first embodiment is movably supported on the shaft 32. The carriage unit 120 moves back and forth distance LI during operation, and a distance printing operation and distance LJ where the capping mechanism in the ink jet printer 100 operates to cap the nozzles 13. The distance LJ should be long enough so that there is a space in which the capping mechanism is comfortably located. This space is actually as wide as the carriage unit 120 may be comfortably positioned. Thus, a total width LH=LI+LJ is required in the first embodiment.

The carriage unit 259 of the second embodiment is movably supported on the shaft 32. The carriage unit 259 moves back and forth a distance LI during the printing operation, and a distance LM during a capping operation. Thus, a total width LK=LI+LM is required in the second embodiment. The distance LM is the distance which the carriage unit 120 travels from a position where the tip of the rod 257 comes into contact with the drive lever 251 to a position where the rod 257 advances into the hole 258 and the carriage 259 is stopped. The distance LM is much shorter than the distance LJ. Thus, the second embodiment eliminates a separate capping mechanism required in the ink jet printer and therefore simplifies the closing and capping operations of the nozzles 13. The elimination of the capping mechanism considerably decreases the overall width of the ink Jet printer. The rod 257 may be replaced by another part of the ink jet printer for the same effect.

Third Embodiment

Figure 10:
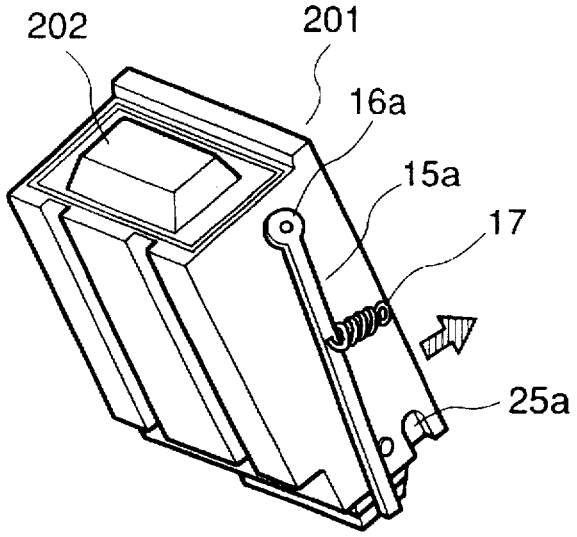
FIG. 10 is a perspective view of an ink cassette according to a third embodiment.
Figure 11:
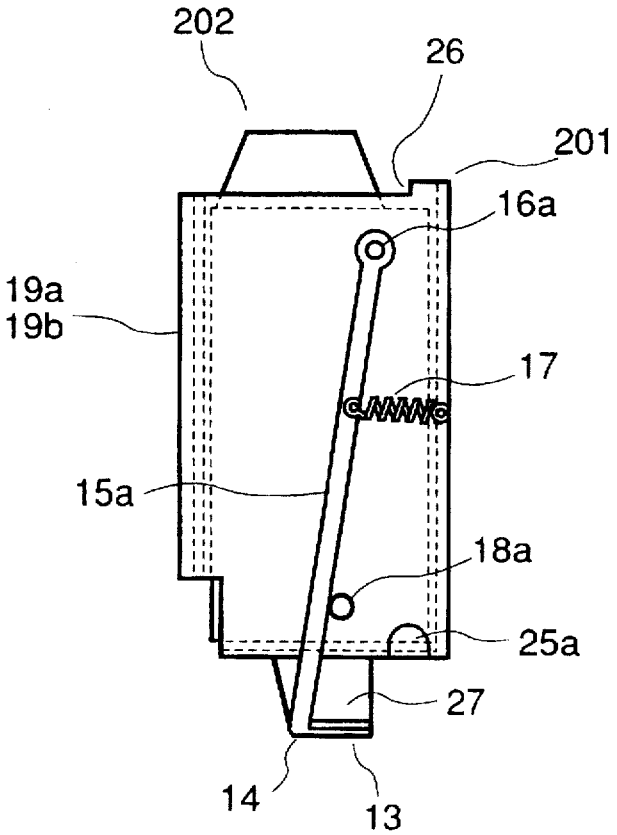
FIG. 11 is a side view of the ink cassette as shown in FIG. 10.
Figure 12:
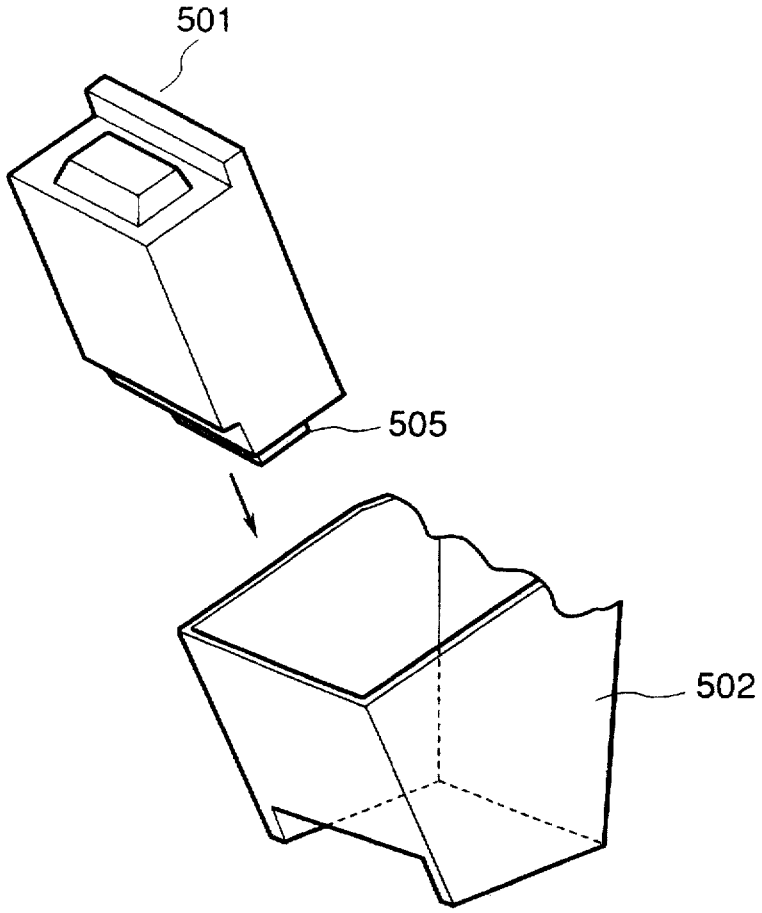
FIG.12 PRIOR ART
FIG. 12 illustrates a conventional ink cassette immediately before it is obliquely inserted into the carriage unit.
Figure 13:
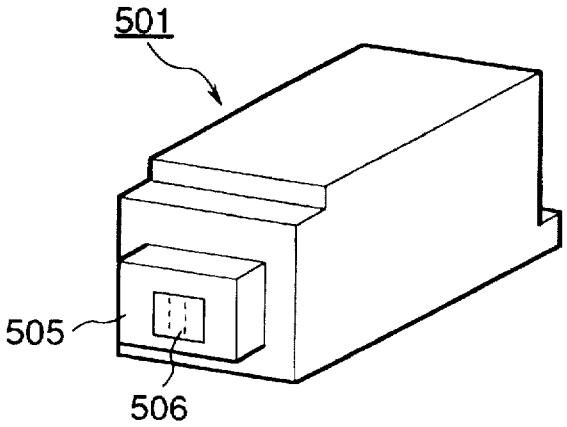
FIG.13 PRIOR ART
FIG. 13 is a perspective view of the ink cassette shown in FIG. 12, showing the print head and nozzles.
Figure 14:
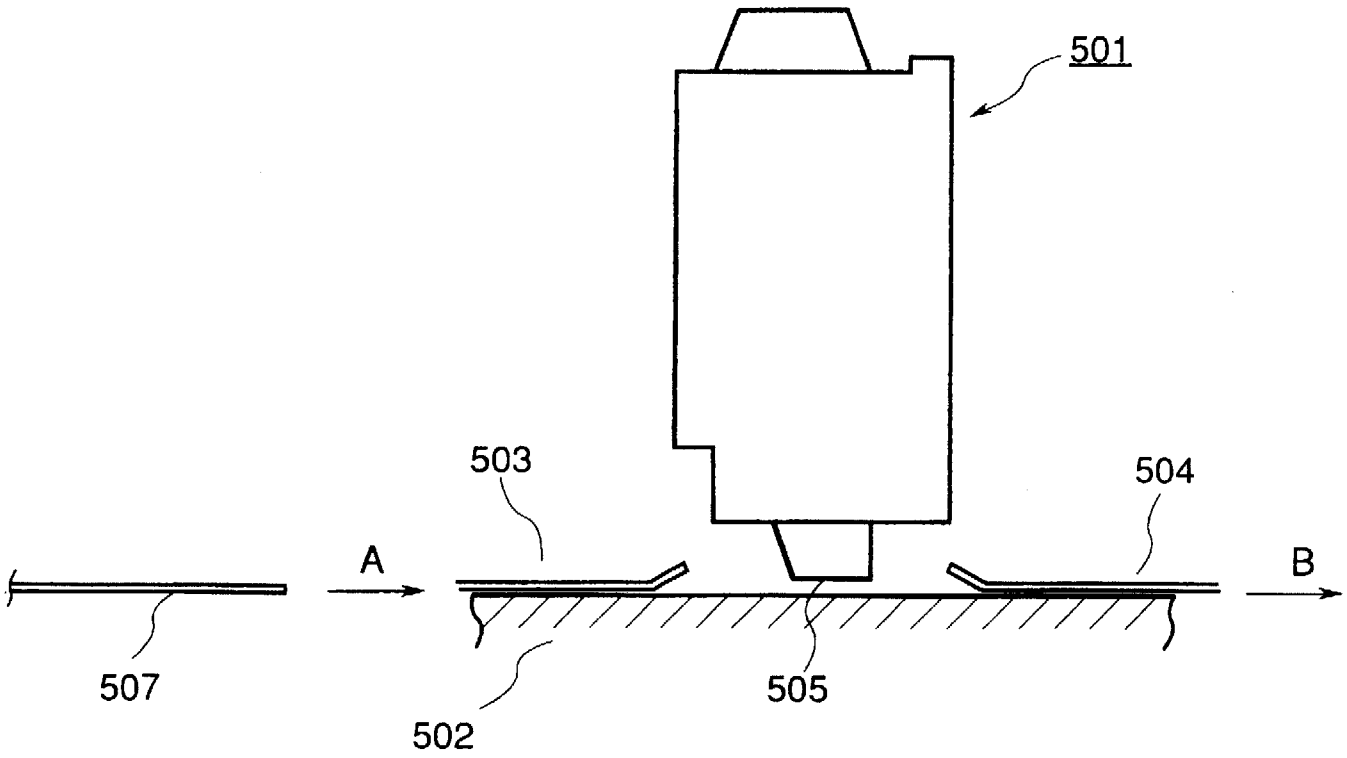
FIG. 14 PRIOR ART
FIG. 14 illustrates the conventional ink cassette as being mounted to the carriage unit and being ready for printing operation.

The first and second embodiments have been described with respect to an ink cassette of a one piece construction where an ink tank is integral with the print head. The present invention is also applicable to ink cassettes of a type where an ink tank is separate from a print head. FIGS. 10 and 11 show an example of one such type of ink cassette. An ink tank 202 is detachably inserted into a print head frame 201 which is a box like housing. When the ink in the ink tank 202 is used up, the ink tank 202 is taken out for replacement of the ink tank or replenishment of ink. The rest of the construction and operation thereof are the same as those of the first and second embodiments and therefore description thereof is omitted.

What is claimed is:

1. An ink jet printer adapted for using an ink cassette, the ink cassette having a print head, a cap movable between a cap-opening position and a cap-closing position in which the cap covers the print head, and a first biasing means that exerts a first biasing force for biasing the cap to the cap-closing position, the ink jet printer comprising:

a carriage unit, the ink cassette being receivable therein; and a second biasing means mounted to said carriage unit for biasing the cap to the cap-opening position when the ink cassette has been received in said carriage unit, said second biasing means exerting a second biasing force greater than, and acting in a direction opposite to, the first biasing force.

2. The ink jet printer according to claim 1, wherein said carriage unit is in a print area of said ink jet printer when a printing operation is being performed, and is in a non-print area of said ink jet printer when the printing operation has been completed; and an engagement means for exerting a drive force against the second biasing force to allow the first biasing force to bias the cap to the cap-closing position when said carriage unit has entered the non-print area.

3. The ink jet printer according to claim 1, wherein said second biasing means includes a drive lever connected to said carriage unit, and a spring attached to said drive lever for biasing said drive lever so that the drive lever causes the cap to move to the cap-opening position.

4. The ink jet printer according to claim 2, wherein said second biasing means includes a drive lever connected to said carriage unit, said drive lever having a beveled surface formed thereon, wherein when said carriage unit enters the non-print area, said engagement means contacts the beveled surface and pushes said drive lever to exert the drive force and allow the cap to move to the cap-closing position.

* * * * *